US011204578B2

(12) United States Patent
Sugitani et al.

(10) Patent No.: US 11,204,578 B2
(45) Date of Patent: Dec. 21, 2021

(54) CLEANING DEVICE, WASTE TONER RECOVERY DEVICE, AND IMAGE FORMING DEVICE

(71) Applicant: FUJIFILM Business Innovation Corp., Tokyo (JP)

(72) Inventors: Kazutoshi Sugitani, Kanagawa (JP); Koichi Sato, Kanagawa (JP); Masakazu Shirai, Kanagawa (JP); Hibiki Sasaki, Kanagawa (JP); Kaoru Matsushita, Kanagawa (JP); Kiyotoshi Kaneyama, Kanagawa (JP); Toshihiko Kamiyama, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 16/837,249

(22) Filed: Apr. 1, 2020

(65) Prior Publication Data

US 2021/0055685 A1 Feb. 25, 2021

(30) Foreign Application Priority Data

Aug. 23, 2019 (JP) ..... JP2019-152443

(51) Int. Cl.
*G03G 21/00* (2006.01)
*G03G 21/10* (2006.01)

(52) U.S. Cl.
CPC ..... *G03G 21/0011* (2013.01); *G03G 21/105* (2013.01)

(58) Field of Classification Search
CPC ..... G03G 21/0011; G03G 21/105
See application file for complete search history.

(56) References Cited

U.S. PATENT DOCUMENTS

2009/0232570 A1* 9/2009 Ozawa ..... G03G 21/105 399/358
2014/0301746 A1* 10/2014 Murata ..... G03G 15/0879 399/27
2018/0217526 A1* 8/2018 Imanaka ..... G03G 21/10

FOREIGN PATENT DOCUMENTS

JP 2007-219372 A 8/2007

* cited by examiner

*Primary Examiner* — Walter L Lindsay, Jr.
*Assistant Examiner* — Geoffrey T Evans
(74) *Attorney, Agent, or Firm* — Sughrue Mion, PLLC

(57) ABSTRACT

A cleaning device is provided with: a cleaning component that cleans waste toner from an image holder, the image holder holding, on a surface thereof, a toner image formed by an image forming component and moving in a circulating manner; and a waste toner conveying component that conveys the waste toner toward a waste toner storage unit. The cleaning device has a receiving opening through which waste powder recovered from the image forming component is received, and the waste powder received through the receiving opening is conveyed to the waste toner storage unit by being passed through inside the cleaning device.

23 Claims, 7 Drawing Sheets

CLEANING DEVICE, WASTE TONER RECOVERY DEVICE, AND IMAGE FORMING DEVICE

CROSS-REFERENCE TO RELATED APPLICATIONS

This application is based on and claims priority under 35 USC 119 from Japanese Patent Application No. 2019-152443 filed Aug. 23, 2019.

BACKGROUND

(i) Technical Field

The present disclosure relates to a cleaning device, a waste toner recovery device, and an image forming device.

(ii) Related Art

There is a known image forming device that is provided with: an image carrier that has a toner image formed thereon; an intermediate transfer belt onto which the toner image formed on the image carrier is transferred; an image carrier cleaning component that removes toner remaining on the surface of the image carrier; and an intermediate transfer body cleaning component that removes toner remaining on the surface of the intermediate transfer body. The image forming device is configured such that a recovered toner housing unit is shared by the image carrier cleaning component and the intermediate transfer body cleaning component, and recovered toner from the image carrier cleaning component and recovered toner from the intermediate transfer body cleaning component is introduced to a relay conveying component from mutually different directions and housed in the recovered toner housing unit via the relay conveying component (Japanese Unexamined Patent Application Publication No. 2007-219372).

SUMMARY

Aspects of non-limiting embodiments of the present disclosure relate to a cleaning device that cleans waste toner from an image holder and conveys the waste toner to a waste toner storage unit, and is able to convey waste powder discharged by image forming components and the waste toner from the image holder.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a cleaning device including: a cleaning component that cleans waste toner from an image holder, the image holder holding, on a surface thereof, a toner image formed by an image forming component and moving in a circulating manner; and a waste toner conveying component that conveys the waste toner toward a waste toner storage unit, the cleaning device having a receiving opening through which waste powder recovered from the image forming component is received, and the waste powder received through the receiving opening being conveyed to the waste toner storage unit by being passed through inside the cleaning device.

BRIEF DESCRIPTION OF THE DRAWINGS

An exemplary embodiment of the present disclosure will be described in detail based on the following figures, wherein.

DETAILED DESCRIPTION

Figure 1:
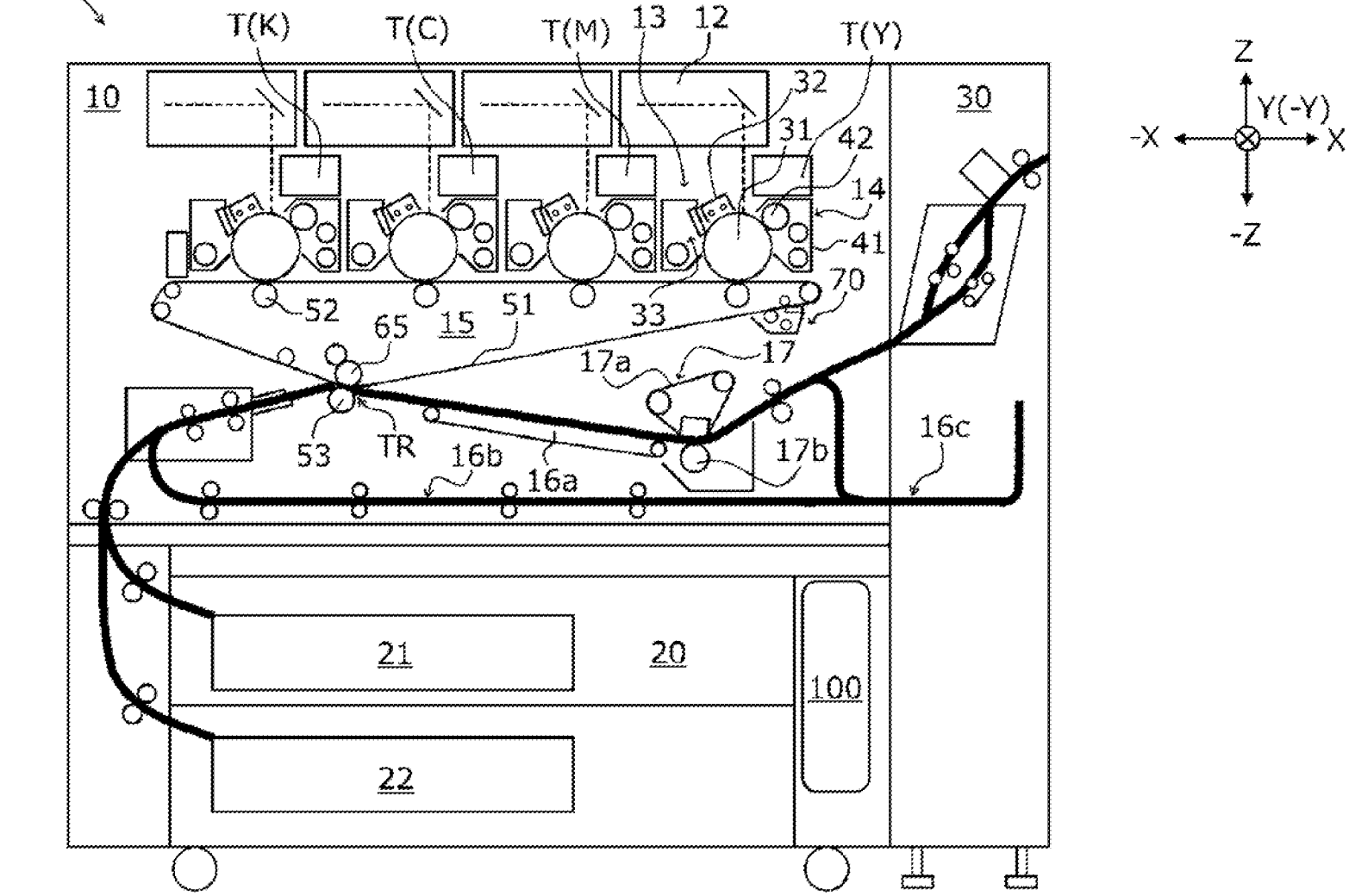
FIG. 1 is a cross-sectional schematic view depicting an example of the schematic configuration of an image forming device.

Next, with reference to the drawings, an exemplary embodiment and specific examples will be given hereinafter for the present disclosure to be described in greater detail; however, the present disclosure is not restricted to the exemplary embodiment and specific examples.

Furthermore, in the description using the drawings hereinafter, please be aware that the drawings are schematic and the ratios of the dimensions and so forth are different from those in reality, and members other than those required for the description are not depicted as appropriate to aid understanding.

It should be noted that, to facilitate understanding of the description given hereinafter, in the drawings, the front-rear direction is taken as the Y axis direction, the left-right direction is taken as the X axis direction, and the up-down direction is taken as the Z axis direction.

(1) Overall Configuration and Operation of Image Forming Device (1.1) Overall Configuration of Image Forming Device FIG. 1 is a cross-sectional schematic view depicting an example of the schematic configuration of an image forming device 1 according to the present exemplary embodiment.

The image forming device 1 is provided with: an image forming unit 10; a paper feeding device 20 mounted below the image forming unit 10; and a paper output unit 30 provided at one end of the image forming unit 10 and from which printed paper is output.

The image forming unit 10 is configured including a system control device (not depicted), exposure devices 12, photoconductor units 13 and developing devices 14 serving as image forming components, a transfer device 15, paper conveying devices 16*a*, 16*b*, and 16*c*, and a fixing device 17, and forms toner images on a recording medium that is fed from the paper feeding device 20.

The paper feeding device 20 supplies the recording medium to the image forming unit 10. More specifically, the paper feeding device 20 is provided with multiple paper loading units 21 and 22 that house recording mediums of different types (materials, thicknesses, paper sizes, and grain directions, for example), and is configured to supply the image forming unit 10 with a recording medium fed out from either one of the multiple paper loading units 21 and 22.

The paper output unit 30 outputs a recording medium onto which an image has been output in the image forming unit 10. Therefore, the paper output unit 30 is provided with an output paper housing unit onto which the recording medium is output after an image has been output thereon. It should be noted that the paper output unit 30 may have a function of carrying out post-processing such as cutting and stapling (needle binding) for a paper bundle that is output from the image forming unit 10.

(1.2) Configuration and Operation of Image Forming Unit

In the image forming device 1 having this kind of configuration, a recording medium is fed to the image forming unit 10 in accordance with an image forming timing, with the recording medium being fed out from the paper loading unit 21 or 22 which is designated for each sheet of printing according to the print job from among the paper loading units 21 and 22.

The photoconductor units 13 (Y, M, C, K; hereinafter, referred to simply as a photoconductor unit 13 when it is not necessary to distinguish therebetween) are respectively disposed in parallel below the exposure devices 12 and are provided with rotationally driven photoconductor drums 31. A charger 32, an exposure device 12, a developing device 14, a first transfer roller 52, and a cleaning device 33 are arranged in the rotation direction of each photoconductor drum 31.

The developing devices 14 have a developing housing 41 that houses developer therein. In the developing housing 41, a developing roller 42 is arranged opposing the photoconductor drum 31. Developer of a regulated thickness is supplied to the developing roller 42 and a toner image is formed on the photoconductor drum 31.

The respective developing devices 14 (Y, M, C, K; hereinafter, referred to simply as a developing device 14 when it is not necessary to distinguish therebetween) are configured in a substantially similar manner apart from the developer housed in the developing housing 41, and respectively form yellow (Y), magenta (M), cyan (C), and black (B) toner images.

Exchangeable toner cartridges T that house developer (toner including carrier) are mounted above the developing devices 14. Toner cartridge guides (not depicted) that supply developer from the respective toner cartridges T (Y, M, C, K) to the developing devices 14 are arranged.

The surfaces of the rotating photoconductor drums 31 are charged by the chargers 32, and electrostatic latent images are formed by latent image-forming light emitted from the exposure devices 12. The electrostatic latent images formed on the photoconductor drums 31 are developed as toner images by the developing rollers 42.

The transfer device 15 is provided with: an intermediate transfer belt 51 serving as an image holder that carries out multiple-transfer of color toner images formed by the photoconductor drums 31 of the photoconductor units 13; first transfer rollers 52 that sequentially transfer the color toner images formed by the photoconductor units 13 to the intermediate transfer belt 51 (first transfer); and a second transfer roller 53 that carries out batch-transfer of the color toner images superposed and transferred on the intermediate transfer belt 51 to the recording medium (second transfer).

The toner images formed on the photoconductor drums 31 of the photoconductor units 13 are electrostatically transferred (first transfer) in a sequential manner onto the intermediate transfer belt 51 by the first transfer rollers 52 to which a predetermined transfer voltage is applied from a power source device or the like (not depicted) controlled by the system control device, and superposed toner images in which the toner images are superposed are formed.

The superposed toner images on the intermediate transfer belt 51 are conveyed to a second transfer unit TR due to the movement of the intermediate transfer belt 51. The second transfer unit TR includes the second transfer roller 53 which is arranged pressed against a backup roller 65 with the intermediate transfer belt 51 interposed.

Paper P is supplied to the second transfer unit TR from the paper feeding device 20 in accordance with the timing at which the superposed toner images are conveyed to the second transfer unit TR. A predetermined second transfer voltage is then applied from a power source device controlled by the system control device, to the backup roller 65 that opposes the second transfer roller 53 with the intermediate transfer belt 51 interposed, and the superposed toner images on the intermediate transfer belt 51 are batch-transferred onto the paper P.

Residual toner on the intermediate transfer belt 51 after transfer of the superposed toner images is removed by a cleaning device 70 and is recovered into a waste toner storage box 100 serving as an example of a waste toner storage unit.

Residual toner on the surfaces of the photoconductor drums 31 is removed by the cleaning devices 33 and is recovered into the waste toner storage box 100 via the cleaning device 70. The surfaces of the photoconductor drums 31 are recharged by the chargers 32.

The fixing device 17 has an endless fixing belt 17*a* that rotates in one direction and a pressure roller 17*b* that comes into contact with the peripheral surface of the fixing belt 17*a* and rotates in one direction, and a fixing region is formed by pressure contact between the fixing belt 17*a* and the pressure roller 17*b*.

The recording medium on which the toner images have been transferred in the transfer device 15 is conveyed to the fixing region of the fixing device 17 via the paper conveying device 16*a* with the toner images in a non-fixed state. The toner images are fixed to the recording medium conveyed to the fixing device 17, by the pair of the fixing belt 17*a* and the pressure roller 17*b* due to a heating and pressure-attaching action.

The recording medium for which fixing has been completed is fed to the paper output unit 30 via the paper conveying device 16*b*.

It should be noted that in a case where images are to be output to both sides of the recording medium, the front and rear of the recording medium are reversed by the paper conveying device 16*c*, and the recording medium is once again fed to the second transfer unit TR in the image forming unit 10. Then, after toner images are transferred and the transferred images are fixed, the recording medium is fed to the paper output unit 30. The recording medium that is fed to the paper output unit 30 is subjected to post-processing such as cutting and stapling (needle binding) as necessary, and is then output to the output paper housing unit.

(2) Waste Toner Recovery Path

Figure 2:
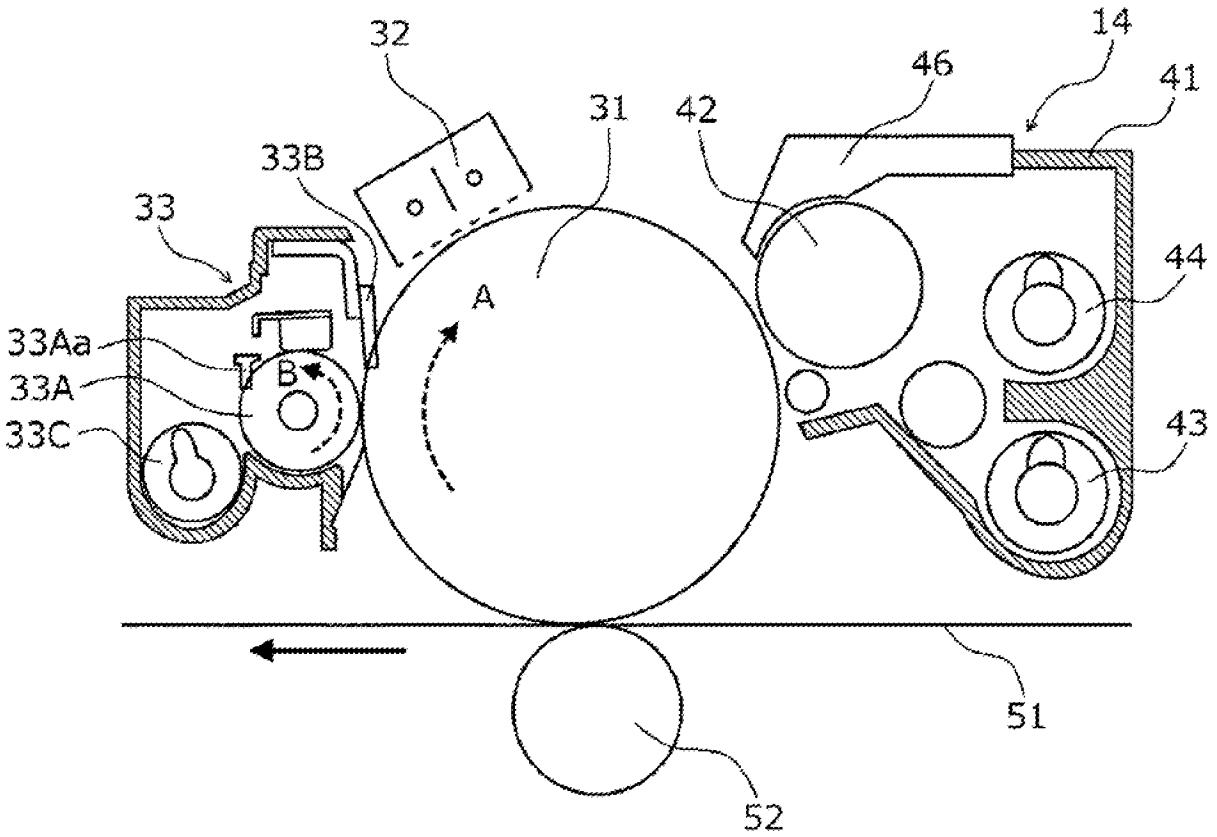
FIG. 2 is a drawing illustrating the configuration of a photoconductor unit and a developing device.
Figure 3:
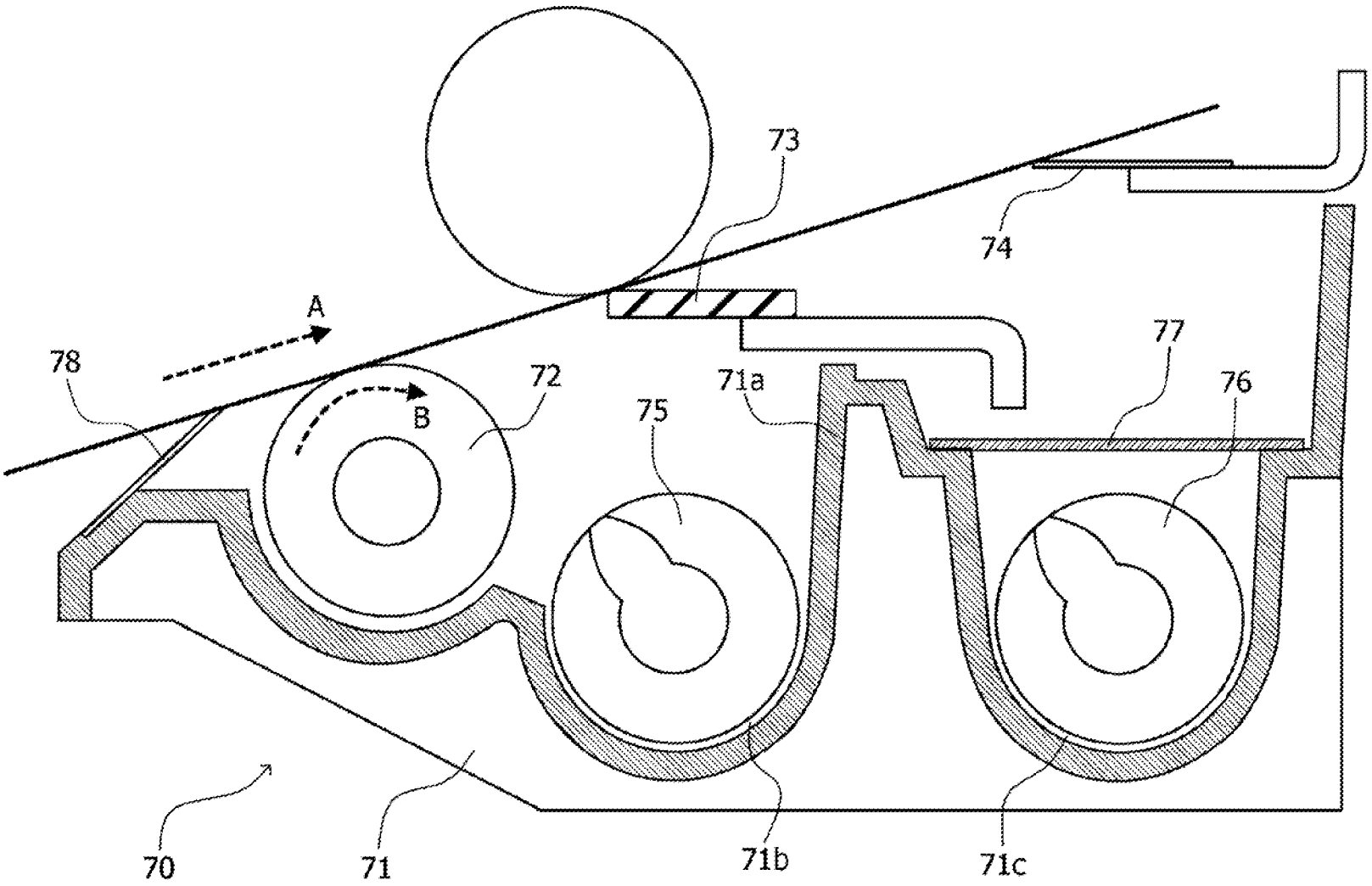
FIG. 3 is a cross-sectional schematic view depicting the configuration of a cleaning device.
Figure 4:
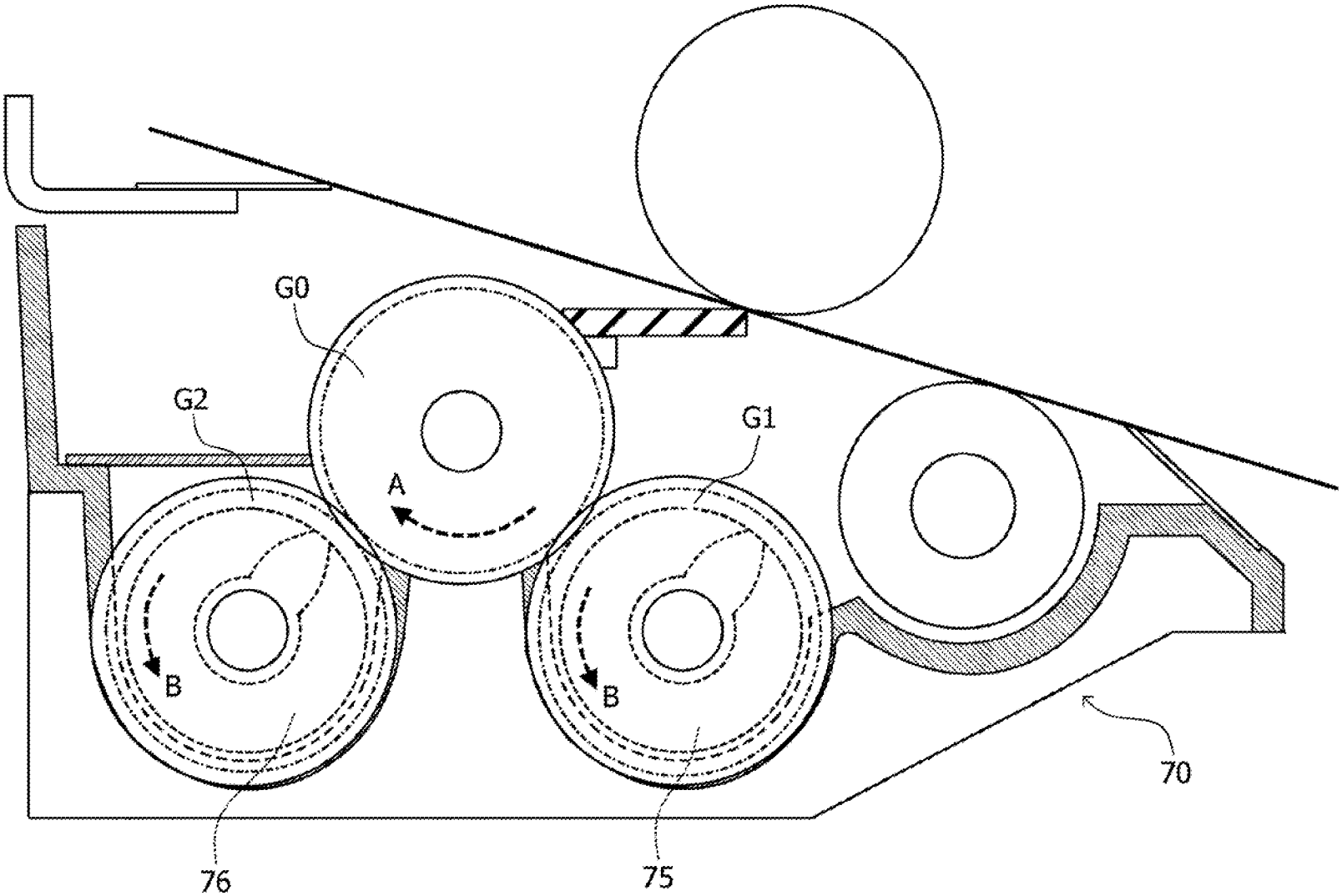
FIG. 4 is a drawing illustrating rotational driving of a first conveying auger and a second conveying auger of the cleaning device.
Figure 5:
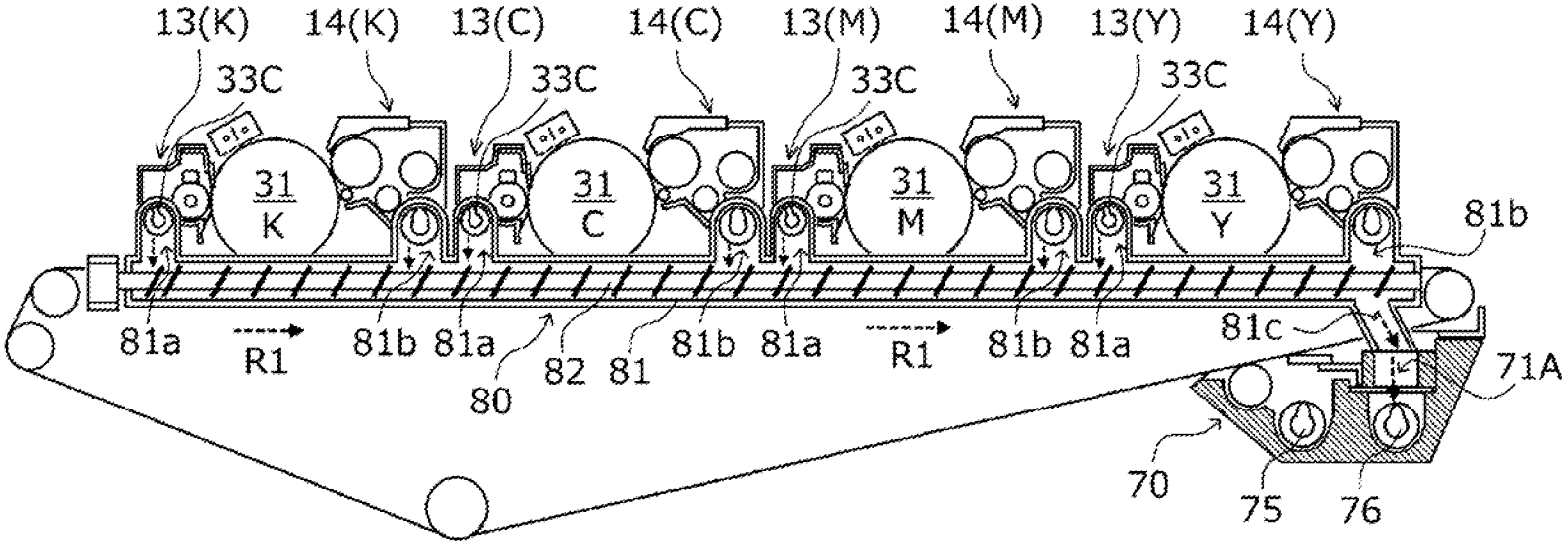
FIG. 5 is a drawing depicting the configuration of a waste toner conveying unit at the front side of the image forming device.
Figure 6:
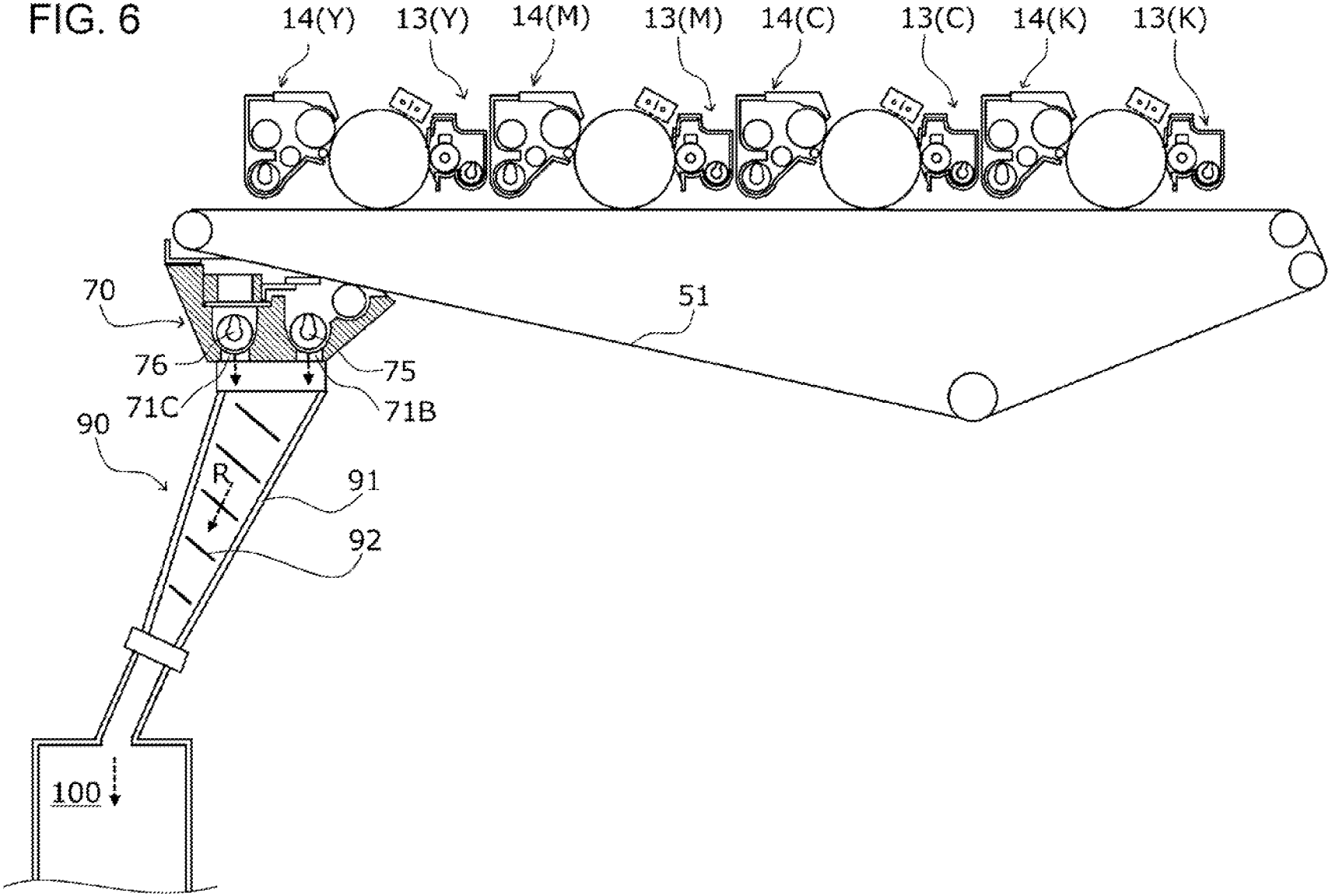
FIG. 6 is a drawing depicting the configuration of a waste toner dropping section at the rear side of the image forming device.

FIG. 2 is a drawing illustrating the configuration of a photoconductor unit 13 and a developing device 14, FIG. 3 is a cross-sectional schematic view depicting the configuration of the cleaning device 70, FIG. 4 is a drawing illustrating rotational driving of a first conveying auger 75 and a second conveying auger 76 of the cleaning device 70, FIG. 5 is a drawing depicting the configuration of a waste toner conveying unit 80 at the front side of the image forming device 1, and FIG. 6 is a drawing depicting the configuration of a waste toner dropping path 90 at the rear side of the image forming device 1.

Hereinafter, the recovery of waste toner from the photoconductor unit 13 and the developing device 14, which serve as an image forming component, and the transfer device 15 will be described with reference to the drawings.

(2.1) Discharge of Waste Toner and Waste Developer

The cleaning device 33 of the photoconductor unit 13 depicted in FIG. 2 cleans recovered matter that is on the photoconductor drum 31 after a toner image has been first-transferred to the intermediate transfer belt 51. The recovered matter includes foreign matter or the like such as residual developer (toner and external additive) and paper powder that has adhered to the photoconductor drum 31 from the recording medium.

A cleaning brush 33A, while in contact with the surface of the photoconductor drum 31, rotates counterclockwise as indicated by arrow B in FIG. 2 (the photoconductor drum 31 rotates clockwise as indicated by arrow A in FIG. 2) and lifts up the recovered matter on the photoconductor drum 31 so as to facilitate the removal thereof.

A cleaning blade 33B scrapes off and thereby removes the recovered matter on the photoconductor drum 31 that has been lifted up by the cleaning brush 33A.

Also, a toner recovery auger 33C is provided in a lower section of the cleaning device 33 and, by rotating, conveys toner removed by the cleaning blade 33B and toner removed from the cleaning brush 33A by a flicker bar 33Aa and housed within the cleaning device 33, along a rotary shaft and outside (waste toner conveying unit 80; see FIG. 5) the cleaning device 33.

In the developing device 14, developer (toner including carrier) supplied into the developing housing 41 is stirred within the developing housing 41 by a stirring auger 43 and is conveyed to the developing roller 42 by a supply auger 44. A portion of the developer is then ultimately discharged outside (waste toner conveying unit 80; see FIG. 5) the developing device 14 as waste developer (hereinafter, referred to simply as developer).

In this way, new developer is supplied into the developing housing 41 and surplus developer is discharged, and, as a result, development is carried out using newly supplied developer without continuously using developer that includes deteriorated carrier.

(2.2) Recovery of Waste Toner from Transfer Device 15

On the intermediate transfer belt 51 of the transfer device 15, the cleaning device 70 is provided downstream from the second transfer unit TR in the movement direction of the intermediate transfer belt 51.

As depicted in FIG. 3, the cleaning device 70 is configured of a housing 71, a cleaning brush 72, a cleaning blade 73, a scraper 74, the first conveying auger 75, the second conveying auger 76, a lid member 77, and a film 78, and recovers, from the intermediate transfer belt 51, untransferred toner remaining on the intermediate transfer belt 51 after the second transfer. The cleaning device 70 is detachably attached to the intermediate transfer belt 51.

The cleaning brush 72, while in contact with the surface of the intermediate transfer belt 51, rotates clockwise as indicated by arrow B in FIG. 3 (the intermediate transfer belt 51 moves as indicated by arrow A in FIG. 3), and lifts up the recovered matter (residual toner, paper powder, and the like) on the intermediate transfer belt 51 so as to facilitate the removal thereof.

The cleaning blade 73 scrapes off and thereby removes the recovered matter on the intermediate transfer belt 51 that has been lifted up by the cleaning brush 72.

The scraper 74, for example, is formed of a metal thin plate material, scrapes off and thereby removes recovered matter that has not been completely removed by the cleaning blade 73, and together with the film 78 seals openings in the housing 71 with respect to the intermediate transfer belt 51 to prevent recovered matter within the housing 71 spewing outside the cleaning device 70.

A first conveyance path 71*b* and a second conveyance path 71*c* partitioned by a partition wall 71*a* are formed in the housing 71. The first conveyance path 71*b* and the second conveyance path 71*c* are formed so as to extend from the front side toward the rear side of the device main body (Y direction) intersecting the movement direction of the intermediate transfer belt 51, and arranged therein are the first conveying auger 75 serving as an example of a waste toner conveying component and a second conveying auger 76 serving as an example of a waste powder conveying component, which serve as examples of conveying screws.

The first conveying auger 75 conveys recovered matter removed from the intermediate transfer belt 51 by the cleaning brush 72 and the cleaning blade 73, toward a waste toner dropping path 90 that is described later.

The second conveying auger 76 receives, from the waste toner conveying unit 80 described later, waste toner and developer discharged from the photoconductor units 13 and the developing devices 14, and conveys the waste toner and developer toward the waste toner dropping path 90.

The second conveyance path 71*c* is closed by the lid member 77 so that the recovered matter conveyed therein does not leak out into the housing 71. Here, when developer including carrier and toner discharged from the developing device 14 gets between the edge of the cleaning blade 73 and the intermediate transfer belt 51, there is a risk of the intermediate transfer belt 51 being scratched by the carrier, the developer being sandwiched between the cleaning blade 73 and the intermediate transfer belt 51, the edge of the cleaning blade 73 being chipped, and the cleaning of the intermediate transfer belt 51 being poor. In the present exemplary embodiment, the second conveyance path 71*c* is closed by the lid member 77, conveyed developer leaking out into the housing is suppressed, and damage to the edge of the cleaning blade 73 caused by the developer is suppressed.

FIG. 4 is a drawing illustrating rotational driving of the first conveying auger 75 and the second conveying auger 76 at the rear side of the cleaning device 70. As depicted in FIG. 4, the first conveying auger 75 and the second conveying auger 76 have gears G1 and G2 respectively at end sections thereof, and the gears G1 and G2 receive a rotational driving force from an input gear G0 that is rotationally driven via a coupling (not depicted) from a drive source (not depicted).

Here, the input gear G0 and the gears G1 and G2 have the same number of teeth and modules, and, due to the input gear G0 rotating in the direction of arrow A depicted in FIG. 4, the gears G1 and G2 rotate in the direction of arrow B depicted in FIG. 4. Thus, the first conveying auger 75 and the second conveying auger 76 have identical configurations, rotate in the same direction, and both convey recovered matter toward the waste toner dropping path 90.

(2.3) Waste Toner Conveying Unit

FIG. 5 is a cross-sectional schematic view depicting the waste toner conveying unit 80. The waste toner conveying unit 80 is provided at the front side of the image forming device 1, and serves as an example of a first conveying component that conveys waste toner and waste developer (hereinafter, referred to as waste powder) which constitute recovered matter that is recovered from the photoconductor units 13 and the developing devices 14.

The waste toner conveying unit 80 is arranged so as to extend horizontally (X direction) along the photoconductor units 13 (Y, M, C, K) and the developing devices 14 (Y, M, C, K) arranged along the intermediate transfer belt 51.

The waste toner conveying unit 80 is configured of a conveying tube 81 that is entirely hollow and houses waste powder therein, and a conveying auger 82 that conveys the waste powder.

Formed in the conveying tube 81 are receiving openings 81*a* through which waste toner discharged from the toner recovery augers 33C (Y, M, C, K) of the photoconductor units 13 (Y, M, C, K) is received, and receiving openings 81*b* through which developer from the developing devices 14 (Y, M, C, K) is received.

Furthermore, a discharge opening 81*c* through which waste powder conveyed by the conveying auger 82 is discharged to the cleaning device 70 is formed in the conveying tube 81.

The conveying auger 82 has a spiral blade formed around a rotary shaft, receives a rotational force from a drive source (not depicted) and rotates along the inner wall within the conveying tube 81, thereby conveying, within the conveying tube 81, the waste powder received through the receiving openings 81*a* and 81*b* (X direction in FIG. 5; see arrow R1).

The waste powder conveyed by the conveying auger 82 within the conveying tube 81 arrives at the discharge opening 81*c* and thereupon drops through a waste powder receiving opening 71A in the cleaning device 70.

(2.4) Waste Toner Dropping Path

FIG. 6 is a cross-sectional schematic view depicting the waste toner dropping path 90. The waste toner dropping path 90 is provided at the rear side of the image forming device 1, and serves as an example of a second conveying component that receives waste powder discharged from the cleaning device 70 and causes the waste powder to drop toward the waste toner storage box 100 (−Z direction) while being stirred.

The waste toner dropping path 90 is configured of: a tubular member 91; an agitator 92 that advances and retreats so as to vibrate in the up-down direction in the internal space of the tubular member 91 and breaks down waste powder that has adhered to the inner wall; and a drive source (not depicted) that transmits a driving force for causing the agitator 92 to advance and retreat. The waste toner dropping path 90 is arranged in a substantially perpendicular direction with respect to discharge openings 71B and 71C of the cleaning device 70.

The waste toner dropping path 90 causes waste powder received from the first conveyance path 71*b* and the second conveyance path 71*c* of the cleaning device 70 to drop toward the waste toner storage box 100 while being stirred by the agitator 92 (see arrow R in FIG. 6).

(2.5) Waste Toner Recovery Path

Figure 7:
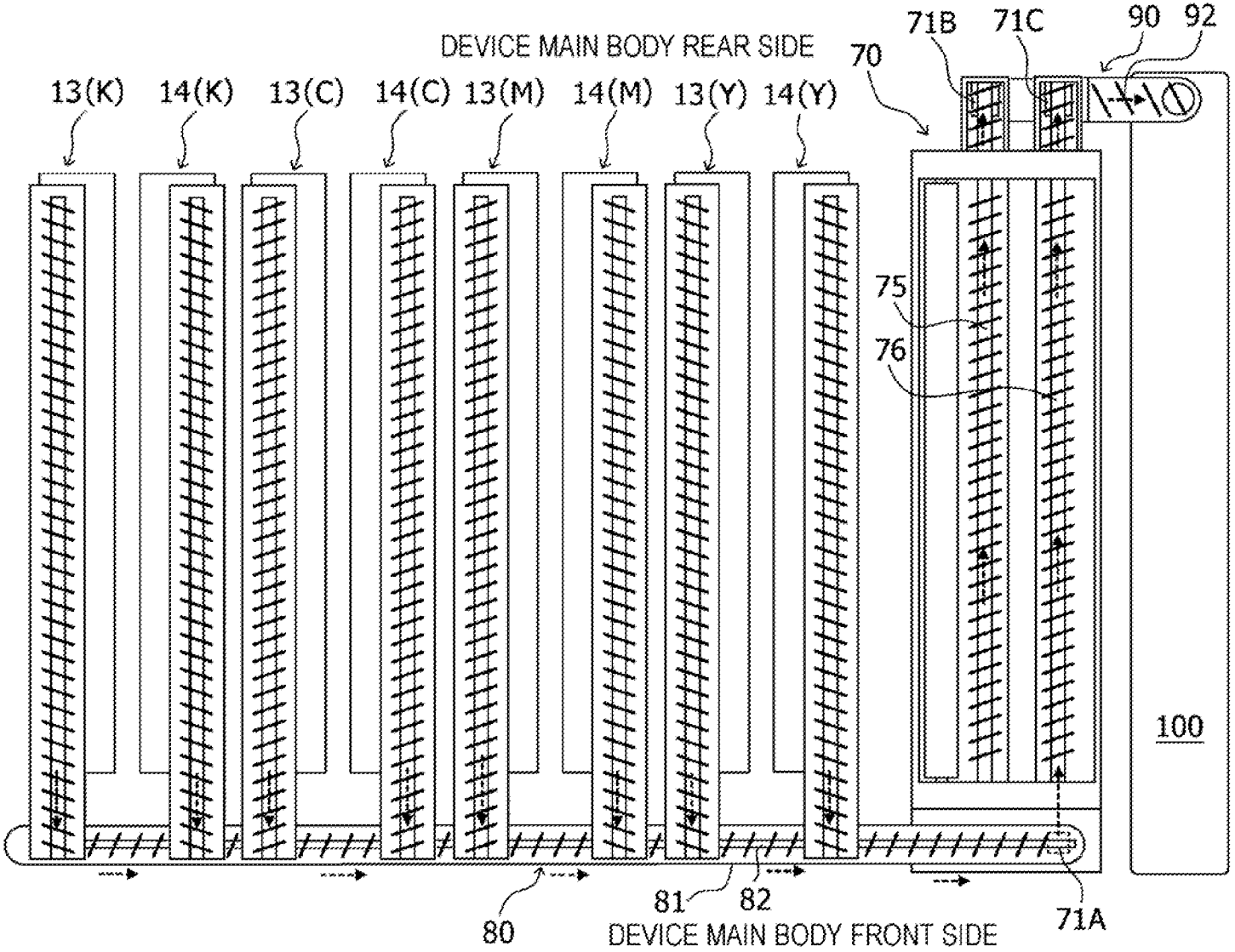
FIG. 7 is a plan schematic view depicting the overall configuration of a waste toner recovery path according to the present exemplary embodiment.

FIG. 7 is a plan schematic view depicting the overall configuration of a waste toner recovery path according to the present exemplary embodiment. The waste toner recovery path is configured with the following being connected as a conveyance path: the waste toner conveying unit 80 that, at the front side of the device main body, receives waste toner recovered by the cleaning devices 33 of the photoconductor units 13 and developer discharged from the developing devices 14 and conveys the waste toner and developer toward the waste powder receiving opening 71A in the cleaning device 70; the cleaning device 70 that scrapes off residual toner on the intermediate transfer belt 51 of the transfer device 15 and conveys the residual toner to the waste toner dropping path 90, and receives waste powder from the waste toner conveying unit 80 and conveys the waste powder through the interior thereof to the waste toner dropping path 90; and the waste toner dropping path 90 that receives the waste toner and waste powder discharged from the first conveyance path 71*b* and the second conveyance path 71*c* of the cleaning device 70 and causes the waste toner and waste powder to drop toward the waste toner storage box 100.

In the present exemplary embodiment, the waste toner conveying unit 80 that conveys waste toner recovered by the cleaning devices 33 of the photoconductor units 13 and developer discharged from the developing devices 14 is arranged at the front side of the device main body. Thus, in a case where waste powder becomes clogged in the waste powder conveyance path, the clogging can be eliminated easily compared to a configuration in which the waste toner conveying unit is arranged at the rear side of the device main body.

In the present exemplary embodiment, waste powder discharged from the photoconductor units 13 and the developing devices 14 is conveyed by the waste toner conveying unit 80 arranged at the front side of the device main body, passes through the interior of the cleaning device 70 that removes residual toner from the intermediate transfer belt 51, and is discharged to the waste toner dropping path 90 arranged at the rear side of the device main body. Thus, the waste powder recovered from the photoconductor units 13 and the developing devices 14 which serve as image forming components can be conveyed toward the waste toner storage box 100 without providing a dedicated conveyance path.

Furthermore, due to the waste toner dropping path 90, which causes waste powder recovered from the photoconductor units 13 and the developing devices 14 and residual toner or the like recovered from the transfer device 15 to drop toward the waste toner storage box 100, being arranged at the rear side of the device main body, the waste toner storage box 100 can be increased in size compared to when arranged at the front side of the device main body. Also, the waste toner storage box 100 can be taken out from the front side of the device main body.

The foregoing description of an exemplary embodiment of the present disclosure has been provided for the purposes of illustration and description. It is not intended to be exhaustive or to limit the disclosure to the precise forms disclosed. Obviously, many modifications and variations will be apparent to practitioners skilled in the art. The embodiment was chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A cleaning device comprising:

a housing which houses elements comprising:

a cleaning component configured to clean waste toner from an image holder, the image holder being configured to hold, on a surface thereof, a toner image formed by an image forming component, wherein the image holder is configured to move in a circulating manner; and a waste toner conveying component configured to convey the waste toner toward a waste toner storage unit, wherein the housing has a receiving opening configured to receive waste powder recovered from the image forming component, and wherein the housing is configured such that the waste powder received through the receiving opening can be conveyed to the waste toner storage unit by being passed through inside of the housing.

2. The cleaning device according to claim 1, further comprising a waste powder conveying component that is separate from the waste toner conveying component, wherein the waste powder conveying component is inside the housing, and wherein the waste powder conveying component is configured to receive the waste powder from one end side of the housing and to convey the waste powder toward an opposing end side.

3. The cleaning device according to claim 2, wherein the waste powder conveying component is closed such that the waste powder does not leak out to the cleaning component.

4. The cleaning device according to claim 3, wherein the waste toner conveying component and the waste powder conveying component have conveying screws that have identical configurations, are configured to rotate in the same direction, and are configured to convey the waste toner and the waste powder, respectively.

5. The cleaning device according to claim 4, wherein the waste powder includes toner and carrier.

6. The cleaning device according to claim 3, wherein the waste powder includes toner and carrier.

7. The cleaning device according to claim 2, wherein the waste powder conveying component is arranged at a position where the waste toner conveying component is between the waste powder conveying component and the cleaning component.

8. The cleaning device according to claim 7, wherein the waste toner conveying component and the waste powder conveying component have conveying screws that have identical configurations, are configured to rotate in the same direction, and are configured to convey the waste toner and the waste powder, respectively.

9. The cleaning device according to claim 8, wherein the waste powder includes toner and carrier.

10. The cleaning device according to claim 7, wherein the waste powder includes toner and carrier.

11. The cleaning device according to claim 2, wherein the waste toner conveying component and the waste powder conveying component have conveying screws that have identical configurations, are configured to rotate in a same direction, and are configured to convey the waste toner and the waste powder, respectively.

12. The cleaning device according to claim 11, wherein the waste powder includes toner and carrier.

13. The cleaning device according to claim 2, wherein the waste powder includes toner and carrier.

14. The cleaning device according to claim 1, wherein the waste powder includes toner and carrier.

15. A waste toner recovery device comprising:

a first conveying component configured to convey waste powder recovered from an image forming component configured to form a toner image;

the cleaning device according to claim 1, configured to receive the waste powder from the first conveying component and to convey the waste powder; and a second conveying component configured to convey the waste toner and the waste powder conveyed by the cleaning device, such that the waste toner and the waste powder drop toward the waste toner storage unit.

16. The waste toner recovery device according to claim 15, wherein the first conveying component is arranged at one end side of the cleaning device, at a front side of the waste toner recovery device.

17. The cleaning device according to claim 1, wherein the waste powder is recovered from at least one of a photoconductor and a developing device.

18. The cleaning device according to claim 17, wherein the cleaning device comprises a conveying tube configured to discharge the waste powder to the receiving opening, wherein conveying tube comprises:

a first receiving opening configured to receive waste toner discharged by a photoconductor; and a second receiving opening configured to receive developer discharged from a developing device.

19. The cleaning device according to claim 1, wherein the waste powder is recovered from a component other than the image holder.

20. The cleaning device according to claim 1, wherein the cleaning device is configured such that the waste powder received through the receiving opening can be conveyed to the waste toner storage unit by being passed entirely through inside of the housing.

21. An image forming device comprising:

a first conveying component configured to convey waste powder recovered from an image forming component configured to form a toner image, at a front side of the image forming device;

a cleaning device comprising a housing configured to discharge waste toner recovered from an image holder configured to hold the toner image on a surface thereof, wherein the image holder is configured to move in a circulating manner, wherein the housing is configured to recover the waste powder conveyed by the first conveying component, toward a waste toner storage unit provided at a rear side of image forming device; and a second conveying component configured to convey the waste toner and the waste powder such that the waste toner and the waste powder drop toward the waste toner storage unit.

22. A cleaning device comprising:

a housing which houses elements comprising:

a cleaning brush configured to clean waste toner from a transfer belt, the transfer belt being configured to hold, on a surface thereof, a toner image formed by a photoconductor and a developing device, wherein the image holder is configured to move in a circular manner; and a waste toner conveying auger configured to convey the waste toner toward a waste toner storage container, wherein the housing has a receiving opening configured to receive waste powder recovered from the photoconductor and the developing device, and wherein the housing is configured such that the waste powder received through the receiving opening can be conveyed to the waste toner storage container by being passed through inside of the housing.

23. An image forming device comprising:

a plurality of image forming components;

a first conveying component configured to convey waste powder recovered from the plurality of image forming components;

a cleaning device comprising a housing which houses a cleaning component configured to clean waste toner from an image holder, wherein the image holder is configured to hold, on a surface thereof, a toner image formed by the plurality of image forming components, and wherein the image holder is configured to move in a circulating manner; and a second waste toner conveying component configured to convey the waste toner cleaned by the cleaning component toward a waste toner storage unit, wherein the housing has a receiving opening configured to receive waste powder conveyed by the first conveying component, and wherein the image forming device is configured to convey the waste powder received through the receiving opening to the waste toner storage unit by passing through inside of the housing.

* * * * *